United States Patent [19]

Phaup

[11] 3,934,820

[45] Jan. 27, 1976

[54] SPRINKLER CONTROL

[75] Inventor: Charles W. Phaup, Dallas, Tex.

[73] Assignee: Telsco Industries, Dallas, Tex.

[22] Filed: Aug. 23, 1974

[21] Appl. No.: 500,051

[52] U.S. Cl. ..... 239/205; 239/73; 239/206; 239/240; 239/246; 239/259; 308/4 R

[51] Int. Cl.[2] ..... B05B 15/10; B05B 3/16

[58] Field of Search ..... 239/71, 73, 201, 203, 204–206, 239/225, 237, 240, 246, 259, 261, 262; 308/4 R, 22, 134.1, 139, 227, 229

[56] References Cited

UNITED STATES PATENTS

| | | | |
|---|---|---|---|
| 1,845,364 | 2/1932 | Thompson | 239/259 |
| 2,393,091 | 1/1946 | De Lacy-Mulhall | 239/206 X |
| 3,107,056 | 10/1963 | Hunter | 239/206 |
| 3,149,784 | 9/1964 | Skidgel | 239/240 X |
| 3,645,451 | 2/1972 | Hauser | 239/206 |
| 3,655,132 | 4/1972 | Rosic | 239/206 |
| 3,702,678 | 11/1972 | Hauser | 239/206 |
| 3,713,584 | 1/1973 | Hunter | 239/206 |
| 3,785,565 | 1/1974 | Perry et al. | 239/206 |
| 3,854,664 | 12/1974 | Hunter | 239/206 |

*Primary Examiner*—Evon C. Blunk
*Assistant Examiner*—Andres Kashnikow
*Attorney, Agent, or Firm*—Richards, Harris and Medlock

[57] ABSTRACT

A rotary sprinkling system which is configured to minimize the accumulation and detrimental effects of debris, and which comprises a pop-up nozzle head secured to an inner housing slidably received within an outer housing and retained by the compressive force of a spring, such inner housing enclosing an impeller driven transmission subjected to only low pressure drops and having a speed-reducing gear train isolated from water flow, a simplified and easily adjustable direction controlling mechanism substantially inaccessible to intermeddlers, and a manually adjustable bypass throttle to control the flow velocity of water driving a water-wheel impeller.

33 Claims, 7 Drawing Figures

SPRINKLER CONTROL

FIELD OF THE INVENTION

This invention relates generally to water sprinklers, and more particularly to a sprinkler having a pop-up nozzle system essentially free from operational failures caused by the accumulation of debris, the application of large pressure drops across a transmission, the use of complicated control mechanisms, and the susceptibility of externally adjustable controls to vandalism.

DESCRIPTION OF THE PRIOR ART

Rotary lawn sprinklers have long been in both private and large scale commercial use. Typically, a sprinkler nozzle head is rotated by a water-driven impeller mechanically linked to the nozzle head by a train speed-reduction gears. Variable-sector rotation of the nozzle head is known, as is the pop-up nozzle head which extends above an outer housing when water under pressure is applied and retracts to a flush position when not in use.

U.S. Pat. No. 3,655,132 discloses a sprinkler system wherein a sprinkler head can be mounted without a housing to be vertically stationary, or can be of the housed pop-up type which is self-flushing each time the sprinkler is used and presents a ground-level profile when not in use. The head can rotate continuously in one direction, or is easily adjusted for part-circle operation over any desired sector. The water motor therein includes a rotatable impeller and a pair of jets arranged for bi-directional operation of the impeller. Switching means at the output of the nozzles which direct water onto the impeller control the jets to determine the direction and extent of nozzle rotation.

Pop-up sprinkling systems in the prior art, however, have not overcome the problems associated with the accumulation of particles of soil or sand, excessive resistance to nozzle rotation, the regulation of the level of power delivered to an impeller in order to limit gear stress, wear and nozzle speed, externally adjustable controls, complicated reversing mechanisms which must be replaced often, high pressure drops across a transmission causing unnecessarily high stresses and strains and possible lubricant extrusion, and the difficulty of determining where the center of the arc sector angle is located when a sprinkler system is in a part-circle mode.

SUMMARY OF THE INVENTION

The present invention is directed to a pop-up sprinkler system substantially protected from accumulation of debris, from interference with adjustable controls, and from operational difficulties caused by complicated mechanisms and unregulated pressure heads.

More particularly, the invention comprises an outer housing, a rotatable nozzle head vertically movable through an outer housing cover, and an inner housing attached to the nozzle head and slidably received within the outer housing.

Enclosed within the inner housing is an impeller driven transmission with a speed-reducing gear train isolated from the flow of water, a manually adjustable by-pass throttle to control the flow velocity of water driving a water-wheel impeller, and an accurate and greatly simplified direction controlling mechanism to control the location and size of an arc sector over which water is to be discharged. As the inner housing is accessible only when the sprinkler head is inoperative and the outer housing cover has been removed, problems associated with easily accessible adjustment controls are minimized without complicating the direction control mechanism.

Under the pressure of water applied to an outer housing water inlet, the nozzle head and inner housing overcome the compressive force of a spring to assume a fully extended position in sealing contact with the outer housing. The flow of water between the water inlet and a drive tube attached to the nozzle head is essentially restriction free to minimize pressure drops across the transmission. The largest pressure drop in the system occurs in the nozzle head, where the water is aspirated by the drive tube constriction.

A sloping outer housing cover with a sand shield in continual contact with the nozzle head, thrust surfaces with at least one rounded head or convex member, and compressive spring forces holding thrust surfaces in continual sealing contact minimize the accumulation of debris within the sprinkler system and diminish the detrimental effects of such debris.

In one aspect of the invention, a marker is inscribed upon the outer surface of the outer housing cover to visually locate the center of the arc sector to be sprayed.

DESCRIPTION OF THE DRAWINGS

For a more complete understanding of the present invention and for further objects and advantages thereof, reference may now be had to the following description taken in conjunction with the accompanying drawings in which.

DESCRIPTION OF PREFERRED EMBODIMENTS

FIG. 1

Figure 1:
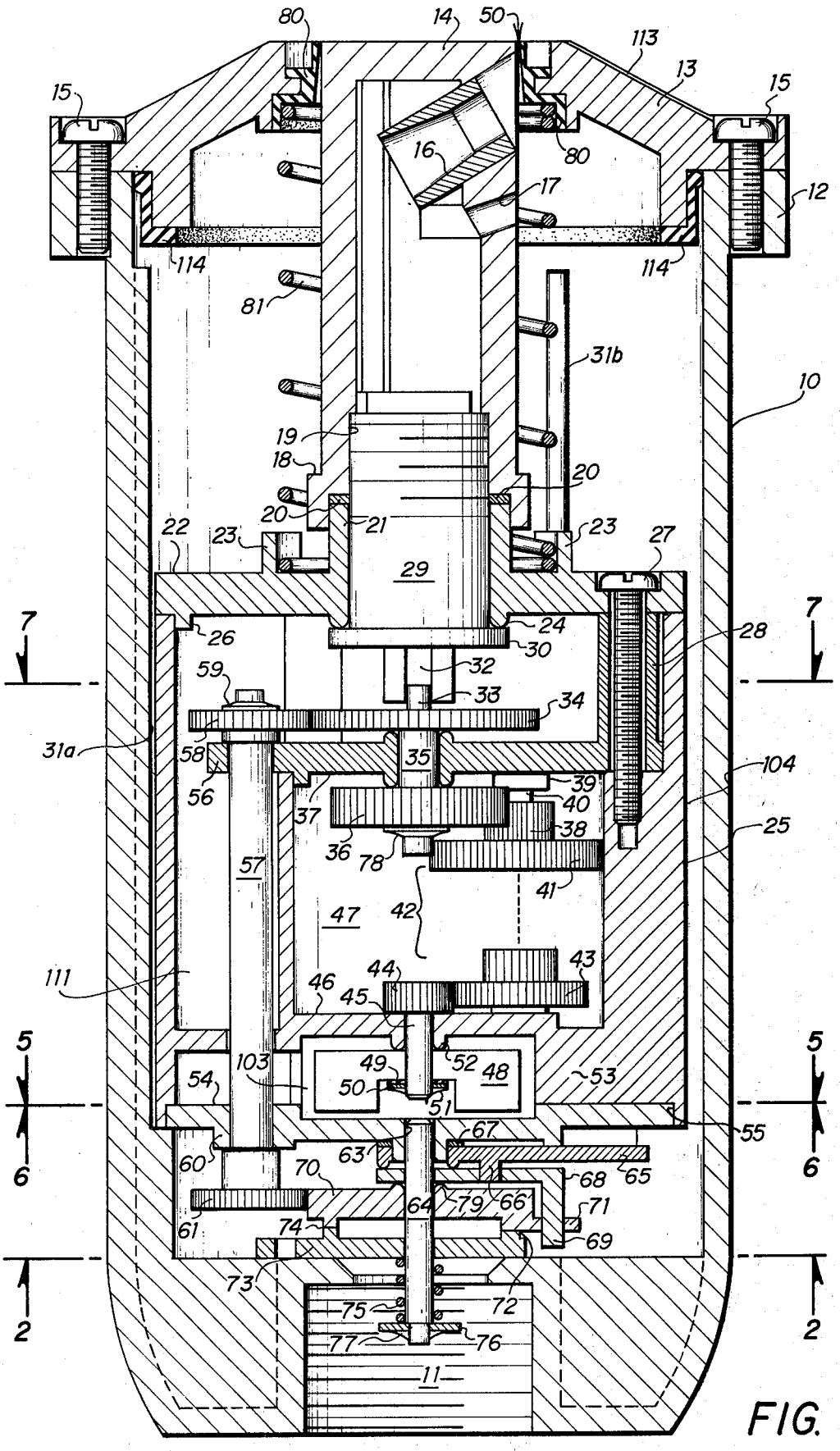
FIG. 1 is a side sectional view of an embodiment of the invention in an upright position.

Illustrated in FIG. 1 is a pop-up, rotary sprinkler system having an outer cylindrical housing 10 with an internally threaded water inlet 11 in an otherwise enclosed lower end, and an outward extending flange 12 about an upper end.

An outer housing cover 13 has a centrally located passage in slidable contact with a nozzle head 14, and is secured to outer housing 10 by means of screws 15 seated within threaded wells of flange 12. Integrally formed within the cover are recesses and shoulders for receiving main water seal 114, nozzle sand shield 80, and the upper end of a nozzle return spring 81.

The nozzle sand shield remains in slidable contact with nozzle head 14 without forming a pressure tight contact. Thus, the possibility of backwash entering the sprinkler head is reduced without appreciably resisting nozzle rotation.

Nozzle head 14 is a hollow cylinder with an enclosed upper end, and an internally threaded lower end 19 subtended by an outer flange 18 having an annular recess with a spring washer 20 seated therein. A nozzle range tube 16 and a secondary nozzle opening 17 are located at one side near the upper end of head 14.

A cylindrical guide bearing 21, integrally formed with a horizontal nozzle bearing plate 22, extends vertically upward to abut washer 20 and seat within the annular recess of flange 18. A portion of bearing 21 extends vertically downward below plate 22 to form a convex, annular thrust surface 24.

Also integrally formed with top plate 22, and extending upward therefrom, are circular arc spring retainers 23 which are concentric to bearing 21 and retain the lower end of spring 81.

Bearing plate 22 forms a cover for an inner housing 25, containing mechanical and fluid communication links between water inlet 11 and nozzle head 14. Plate 22 is secured to housing 25 by means of annular ring segments 26 extending downward from plate 22 near its outer extremity and abutting an inner wall of housing 25, and by bearing plate screws 27 slidably received within spacer bosses 28 and threaded into wells within housing 25.

A cylindrical nozzle drive tube 29, having an externally threaded portion at its upper end and an outer extending rim 30 at its lower end, is threaded into end 19 of nozzle head 14. The upper surfaces of rim 30 are thereby placed in contact with thrust surface 24 of plate 22. Although drive tube 29 is fixedly secured to nozzle head 14, the drive tube remains in rotatable relation with the inner walls of bearing 21. In addition, the outer walls of bearing 21 are in rotatable relation with the downward extending inner walls of the annular recess of flange 18. Thus, a rotation of drive tube 29 causes both the drive tube and head 14 to rotate with respect to bearing 21.

With the interconnection of drive tube 29 and head 14, an integral unit is formed including head 14, plate 22, and inner housing 25. With cover 13 removed from outer housing 10, the integral unit may be inserted within housing 10 and positioned by means of a plurality of guide keys indicated generally at 31*a* and 31*b*. The guide keys are designed to slidably receive housing 25 through a guide keyway 112, FIGS. 2–7, formed integrally with housing 25 and plate 22. Thus, while the nozzle may rotate with respect to bearing plate 22 and inner housing 25, the guide keys prevent the bearing plate and inner housing from rotating with respect to outer housing 10.

Embodied within inner housing 25 are a direction controlling mechanism and a transmission including a 1008 to 1 speed-reducing gear train. The transmission is linked to drive tube 29 by a keyway slot 32 attached to and extending vertically downward from the lower surface of rim 30. Slot 32 receives a drive key 33 integrally formed on a gear member including a reversing input gear 34, a nozzle drive shaft 35, and an output gear 36. The gear member is held firmly in place by a gear cover plate 37 having a vertically extending spacer boss 28 at one end, and a cylindrical opening defined by convex, annular thrust surfaces extending above and below near the center of the plate. The thrust surfaces abut the lower surface of gear 34 and the upper surface of gear 36. Gear 36 in turn is forced against the downward extending thrust surface of plate 37 by a push-on retainer 78 subtending the lower end of drive shaft 35.

In meshing relationship with output gear 36 is a pinion gear 38 integrally formed with a spur gear 41 on gear shaft 40. Gear shaft 40 in turn is held in place by a gear shaft boss 39 integrally formed with plate 37. The reduction gear element, comprising pinion gear 38 and spur gear 41, is part of a train of reduction gear elements generally indicated by reference number 42. Each member of the reduction gear train is held in place by gear shaft bosses formed integrally with an intermediate partition plate 46 and designed to premanently receive member gear shafts. The gear elements are so arranged that a spur gear of one gear element meshes with a pinion gear of a succeeding gear element, until spur gear 43 meshes with an input pinion gear 44 on an impeller shaft 45. In the preferred embodiment herein described, there is a total of five reduction gear elements comprising a pinion gear and a spur gear which, with output gear 36 and pinion gear 44, consists of six gear meshes. With this configuration, nozzle head 14 rotates in the same direction as impeller shaft 45.

Gear cover plate 37, plate 46, and internal walls of inner housing 25 form an enclosed transmission chamber 47, thereby isolating output gear 36, gear train 42, and pinion gear 44 from the flow of water through the sprinkler system.

Linking the transmission to a water-wheel impeller 48 is impeller shaft 45, which is rotatably seated within a cylindrical guide bearing integrally formed with the horizontal arm of plate 46. Impeller 48 is keyed to the lower end of impeller shaft 45 and held in place by a spring washer 49, an impeller washer 50, and a push-on retainer 51. An upper surface of impeller 48 is thus forced against downwardly extending convex thrust surfaces 52.

Impeller 48 is enclosed within an impeller flow chamber 103 defined by the lower horizontal surface of plate 46, the upper surface of an impeller cover plate 54, and partition walls 53 which are integral with plate 46 and abut a flat portion of the upper surface of plate 54.

Plate 54 is slidably received by a lower cylindrical opening 55 of inner housing 25, and secured to the lower surface of plate 46 with screws.

In operation, water flowing through impeller flow chamber 103 forces impeller 48 to rotate, by way of example, in a clockwise direction. Impeller shaft 45 imparts the clockwise motion to input pinion gear 44 which is linked to gear train 42. As previously mentioned, output gear 36 rotates in the same direction as input pinion gear 44 when gear train 42 comprises five reduction gear elements. Therefore, in the preferred embodiment herein described, nozzle drive shaft 35 keyed to output gear 36 imparts a clockwise rotary motion to drive key 33, which in turn forces drive tube 29 and nozzle head 14 to rotate in a clockwise direction.

Also embodied within inner housing 25 is an adjustable direction controlling mechanism which controls both the location and the size of an arc sector angle over which water is to be discharged. The controlling mechanism is linked through reversing input gear 34 on nozzle drive shaft 35 to both the transmission of inner housing 25 and nozzle drive tube 29.

In meshing relationship with input gear 34 is a reversing gear 58, which is keyed to a reversing gear shaft 57 and held in place by a push-on retainer 59. An upper portion of shaft 57 is rotatably received within a gear shaft bearing 56 integrally formed with plate 37. The lower end of shaft 57 is rotatably seated within a cylindrical guide bearing 60 integrally formed with plate 54. Secured to the lower end of shaft 57 is a reversing gear 61 held in place by a press fit or solvent welding technique.

In addition to guide bearing 60, impeller cover plate 54 contains a centrally located, downwardly opening boss hole 63 in which a shaft 64 is fixedly seated. Transverse to and rotatably mounted upon shaft 64 are manually adjustable members of the direction controlling mechanism.

More particularly, a reversing plate 65 having a downward extending pin 66 is separated from the lower surface of cover plate 54 by a reversing plate friction washer 67. A convex, annular thrust surface integral to and extending downward from plate 65 vertically positions a reversing arm 68, which is in registration with pin 66. A vertical pin 69 extends downward from arm 68 to a horizontal surface of outer housing 10.

Abutting reversing arm 68 is an upward extending thrust surface 79 defining a guide bearing integrally formed with a trip gear 70, having a transverse arm 71 which is in registration with pin 69. Gear teeth defining the outer perimeter of trip gear 70 intermesh with gear 61. In addition, a spacer 72 integrally formed with trip gear 70 extends downward to abut a trip plate 73.

Both trip gear 70 and trip plate 73 have integrally formed clutch teeth, indicated generally at 74, which intermesh to provide an accurate means for adjusting the size of an arc sector angle over which water is to be discharged.

A compression spring 75, a retaining washer 76 and a push-on retainer 77 act in conjunction to hold the thrust surfaces of the trip plate, trip gear, reversing arm, and reversing plate in continual sealing contact to prevent sand from accumulating between surfaces.

FIG. 2

Figure 2:
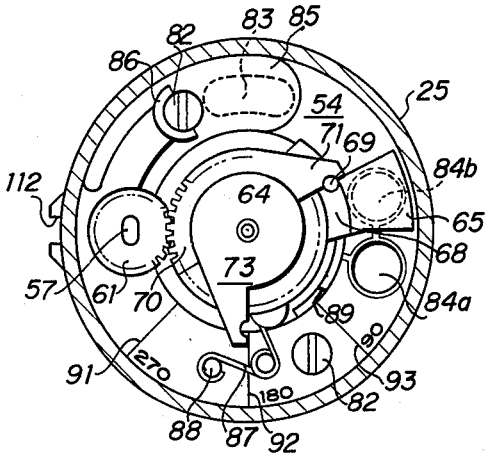
FIG. 2 is a transverse sectional view of the invention looking up along line 2—2 of FIG. 1.

The mechanical interrelationships between the members of the direction controlling mechanism are better illustrated in FIG. 2, where trip plate 73, trip gear 70, reversing arm 68, reversing plate 65, and impeller cover plate 54 are shown in stacked relation proceeding upward along shaft 64. Plate 54 is secured to plate 46, FIG. 1, by impeller cover plate screws 82.

An overcenter spring 87 has one leg attached to an integrally formed shaft 88 of plate 54, and a second leg attached to a shaft integrally formed with the upper surface of reversing arm 68.

Extending downward from impeller cover plate 54 is a limit stop 89 which limits the movement of reversing plate 65 about shaft 64. When reversing plate 65 is in contact with stop 89, the reversing plate is directly centered over an impeller inlet opening 84*a*, thereby forcing water to flow through an impeller inlet opening 84*b* indicated by dotted lines in FIG. 2. This causes the water-wheel impeller 48 to rotate in a direction opposite to that induced by water flowing through inlet opening 84a.

Inscribed on the underside of plate 54 are radial lines 91–93, and associated numbers 270, 180, and 90 which represent angular measurements used in accurately locating the center of an arc sector as described below.

In operation, when reversing input gear 34 of FIG. 1 rotates in a clockwise direction as viewed from the lower end of inner housing 25, a counterclockwise rotation is induced in reversing gear 61, causing trip gear 70 to rotate in a clockwise direction about shaft 64. The clockwise rotation of trip gear 70 brings arm 71 into contact with reversing arm pin 69. As the clockwise rotation of trip gear 70 continues, reversing arm 68 is forced to rotate clockwise about shaft 64.

FIG. 3

Figure 3:
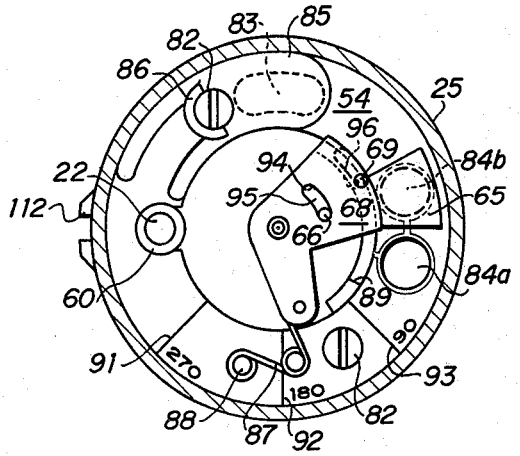
FIG. 3 is the transverse sectional view of FIG. 2 with trip plate, trip gear, and reversing gear removed.

The clockwise rotation of reversing arm 68 continues until after pin 69 becomes diametrically opposite to shaft guide bearing 60 as illustrated in FIG. 3. At this point, the extreme counterclockwise end 94 of slot 95, formed in reversing arm 68, comes into contact with reversing plate pin 66 slidably received in slot 95. Overcenter spring 87 then snaps reversing arm 68 to an extreme clockwise position, which is preferably sixty degrees clockwise from the extreme counterclockwise position illustrated in FIG. 3. The snap action movement of reversing arm 68 causes reversing plate 65 to uncover inlet opening 84b and rotate clockwise until it comes into contact with limit stop 89. Reversing plate 65 then is directly centered over inlet opening 84*a*. Thus, water flowing into inlet 11, FIG. 1, is directed through inlet opening 84*b* to reverse the direction of rotation of impeller 48 and nozzle head 14.

The snap action motion is delayed until after pin 69 becomes diametrically opposite to bearing 60 to prevent a null torque condition on impeller 48. Further, the action of spring 87, the extreme ends of slot 95, and reversing plate friction washer 67, FIG. 1, prevent plate 65 from partially uncovering an impeller inlet opening before or after the snap action motion. Plate 65 is thus held in an extreme position against either a limit stop 96, indicated by dotted lines in FIG. 3, or limit stop 89.

Before applying water under pressure to the sprinkler system, the arc sector size may be increased or decreased by rotating trip plate 73 relative to trip gear 70 by a number of clutch teeth 74, FIG. 1, which preferably are angularly spaced five degrees apart. This is accomplished by pulling trip plate 73 downward against spring 75 on shaft 64. When clutch teeth 74 are again intermeshed, compression spring 75, retaining washer 76 and push-on retainer 77 act in combination to hold the trip gear and the trip plate together. Sufficient force is applied to prevent relative movement between the two during the process of moving reversing arm 68 from an extreme holding position to an overcenter switching position.

FIG. 4

Figure 4:
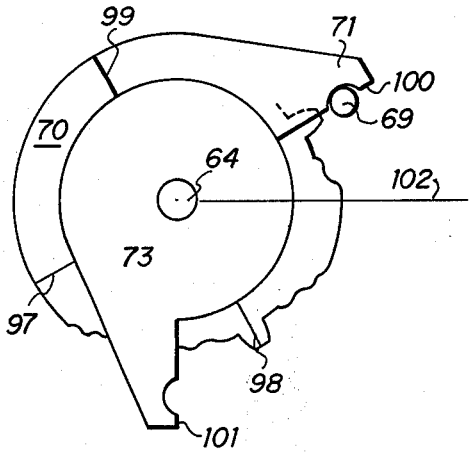
FIG. 4 is a plan view looking up at a trip plate, a trip gear, and a reversing arm pin in working relation.

More particularly, as illustrated in FIG. 4, radial lines 97–98 inscribed on the lower surface of trip gear 70, and radial edges 99–100 of arm 71 are each centrally located over a gear tooth and are spaced 90° apart. Thus, if the radial edge 101 of trip plate 73 is placed directly over radial line 98, the clockwise angle between radial edge 100 and radial edge 101 is 90° corresponding to a 90° arc sector over which water is to be discharged. Likewise, with radial edge 101 aligned with radial line 97, the clockwise angle between radial edges 100 and 101 is 180°. It is seen that an arc sector slightly less than 360° may be described by nozzle head 14 in part-circle mode operation.

As previously described, the snap action motion created by spring 87, FIGS. 2 and 3, occurs when pin 69 and radial edge 100 become diametrically opposite to guide bearing 60. Therefore, with radial lines 91–93 of FIGS. 2 and 3 preferably spaced clockwise by angles 135°, 90°, and 45°, respectively, from an overcenter actuating position indicated by line 102, FIG. 4, a center of an arc sector may be positioned by the following adjustments:

1. Align radial edge 101 with a radial line 97–98 or radial edge 99 to define a desired arc sector angle as before described.
2. Position radial edge 101 over a radial line 91–93 on plate 54 by rotating trip gear 70 and trip plate 73 in unison. This is accomplished by pulling downward against spring 75 to disengage trip gear 70 from reversing gear 61, and rotating the trip gear in unison with trip plate 73. Trip gear 70 is then remeshed with reversing gear 61 and held in place under the force of spring 75.
3. Align nozzle range tube 16 with the center of spacer boss 28, FIG. 1, thereby aligning a radially inscribed marker 113 on the top of outer housing cover 13 with the center of the arc sector angle. An operator is thus provided with a visual indication of an arc center position.

The motive power for the sprinkling system illustrated in FIG. 1 is the water pressure supplied through a water pipe or riser threaded into water inlet 11. As pressurized water enters through the water inlet, the pressure inside outer housing 10 and inner housing 25 begins to increase. This pressure increase continues until a lifting force is developed which is sufficient to overcome the resistance of nozzle return spring 81. During the period required for pressure buildup, water flows around clearance space 104 between inner housing 25 and outer housing 10, and flushes out around nozzle sand shield 80 any sand or debris which may have accumulated within the sprinkler head.

When a sufficient lifting force occurs, inner housing 25 and all components attached thereto rise to a fully extended position with the top surface of nozzle bearing plate 22 in sealing contact with main water seal 114 located along the outer perimeter of cover 13. This sealing contact along the outer perimeter of cover 13 significantly reduces the stress induced in cover 13 which will allow higher internal water pressures for a given cover thickness; or it will allow the cover to be thinner for a given internal water pressure. This sealing contact also forces all incoming water through openings in impeller cover plate 54 as illustrated in FIGS. 2 and 3.

A by-pass opening 83, formed in plate 54 and indicated by dotted lines in FIGS. 2 and 3, allows a portion of the pressurized water to be diverted around water-wheel impeller 48. The by-pass opening is controlled by a by-pass throttle plate 85, which is secured in a desired position by a clamp washer 86 and one of the impeller cover plate screws 82. As flow rates increase beyond a predetermined value, plate 85 may be manually moved clockwise to uncover a larger portion of by-pass opening 83. Thus, nozzle speed and output torque can be confined to a desired limit which will reduce gear stress and wear as flow is increased.

As before described, plate 54 also contains inlet openings **84*a* and 84*b* which are in direct fluid communication with impeller flow chamber 103, FIG. 1. Thus, that portion of the water not directed through by-pass opening 83 flows through one of the impeller inlet openings. As illustrated in FIGS. 2 and 3, when reversing plate 65 has closed off inlet opening 84*b*, the water is forced to flow through inlet opening 84*a* into flow chamber 103**.

FIGS. 5–7

Figure 6:
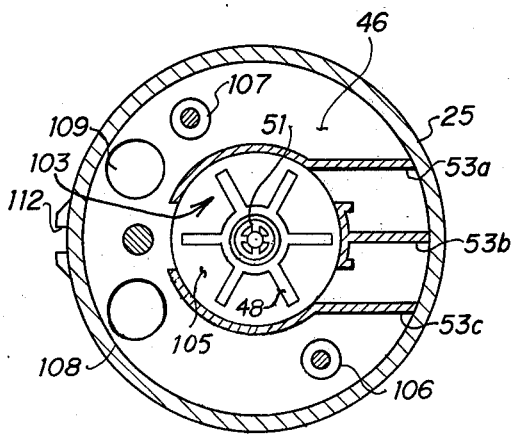
FIG. 6 is a transverse sectional view looking up along line 6—6 of FIG. 1.

Flow chamber 103, as illustrated in FIG. 6, is formed from partition walls **53*a*, 53*b* and 53*c* integral with the lower surface of plate 46. Threaded bosses 106 and 107 receive impeller cover plate screws 82 to secure plate 54 to plate 46, with the lower surfaces of partition walls 53*a*, 53*b* and 53*c* resting against the flat portion of the upper surface of plate 54**.

Figure 5:
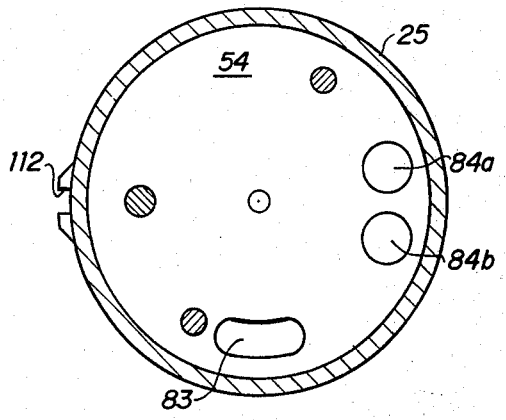
FIG. 5 is a transverse sectional view looking down along line 5—5 of FIG. 1.

Water-wheel impeller 48 is seated within a circular depression 105, FIGS. 5 and 6, which is formed in the lower surface of plate 46 and the upper surface of plate 54.

The water flow continues upward through an inlet opening, **84*a* or 84*b*, to impart a rotating motion to impeller 48, which in turn drives the transmission embodied within inner housing 25 as previously described. In contrast, that portion of the water directed through by-pass 83 rises within a chamber defined by the inner wall of housing 25, and partition walls 53*a* and 53*c*, without imparting a motion to impeller 48**.

From by-pass opening 83 and flow chamber 103, water passes through flow chamber inlet ports 108 and 109 which are in direct fluid communication with a water flow chamber 111, FIG. 1.

Figure 7:
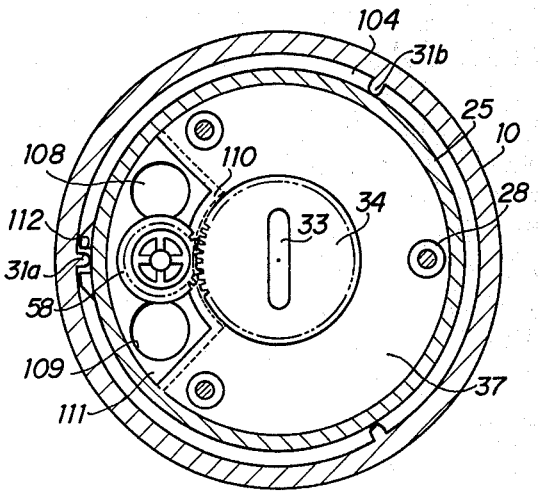
FIG. 7 is a transverse sectional view looking down along line 7—7 of FIG. 1.

As illustrated in FIG. 7, water flow chamber 111 is formed from a partition wall 110 integral with the upper surface of intermediate partition plate 46.

Under pressure, the water continues upward from flow chamber 111 and through nozzle drive tube 29 where the water is aspirated. The water then exits through nozzle range tube 16 and auxiliary nozzle opening 17.

In accordance with the invention, which obviates frequently occurring maintenance problems and enhances the efficiency of the mechanical linkages herein described, output gear 36, gear train 42, and pinion gear 44, FIG. 1, are isolated from the flow of water. In addition, there is provided a by-pass throttle plate 85 to divert a portion of the water from impeller 48 when water pressure is excessive, an inner housing 25 having a water flow substantially free of restrictions to minimize pressure drops across the transmission enclosed within the inner housing, and a simplified direction controlling mechanism less susceptible to the operational failures of prior complicated mechanisms. Further, all confronting thrust surfaces within the sprinkler system have at least one convex member to effectively reduce the detrimental effects of debris.

The possibility of debris accumulating within the sprinkler system also is diminished. For example, a sloping upper surface of cover 13, FIG. 1, acting in conjunction with sand shield 80 prevents the accumulation of backwash about nozzle heat 14, and, in the event seepage about head 14 occurs, spring washer 20 produces a constant upward force on nozzle drive tube 29 to prevent the passage of debris around thrust surfaces 24 into housing 25.

To protect the direction control mechanism from debris which may enter through water inlet 11, a compression spring 75, acting in concert with washer 76 and push-on retainer 77, holds the thrust surfaces of trip plate 73, trip gear 70, reversing arm 68, and reversing plate 65 in continual sealing contact.

To combat the intermeddler who tampers with easily accessible sprinkler controls, the direction controlling mechanism is placed beneath inner housing 25 which is enclosed within outer housing 10. Thus, both other housing cover 13 and inner housing 25 must be removed to have access to the direction controlling mechanism. If the sprinkler system is merely reoriented on the input riser, a marker inscribed on the outer surface of cover 13, line 113 of FIG. 1, visually locates the center of the arc sector over which water is to be discharged.

Having described the invention in connection with certain specific embodiments thereof, it is to be understood that further modifications may now suggest themselves to those skilled in the art and it is intended to cover such modifications as fall within the scope of the appended claims.

What is claimed is:

1. In a pop-up, rotary sprinkler system having an outer housing, a nozzle head vertically and rotatably movable through an outer housing cover, and an inner housing attached to the nozzle head and slidably received within said outer housing, such inner housing enclosing an adjustable direction controlling mechanism and a transmission driven by a water-wheel impeller, the combination which comprises:

a. convex thrust rings integrally formed with cover and partition plates within said inner housing having surfaces confronting surfaces of rotating members of said transmission; and b. resilient means to maintain said surfaces in contact with one another.

2. The combination set forth in claim 1 in which said transmission includes a manually adjustable direction controlling means on the underside of said inner housing mechanically linked to said transmission for varying the angular width of an arc sector and the azimuth of the center of said arc sector over which water is to be discharged.

3. The combination set forth in claim 1 wherein said transmission includes a train of speed-reduction gears enclosed in a water chamber sealed by said surfaces.

4. The combination set forth in claim 2 wherein confronting thrust surfaces of said controlling means are rotatably mounted on a shaft extending from a bottom plate of said inner housing and held in continual sealing contact by a compression spring.

5. The combination set forth in claim 4 wherein said controlling means includes, in downward sequence, said shaft, a friction washer, a reversing plate having a first downward extending pin, a reversing arm in registration with said first pin and having a second downward extending pin, a trip gear mechanically linked to said transmission and having both a first arcuate section of downward extending clutch teeth and a transverse arm in registration with said second pin, and a trip plate having a second arcuate section of upward extending clutch teeth in meshing relationship with said first arcuate section.

6. A pop-up, rotary sprinkler system comprising:

a. a cylindrical outer housing having an open upper end and a threaded port at a lower end for receiving a water supply conduit;

b. a cover for said outer housing having a central opening;

c. a cylindrical nozzle head having a lower open end and rotatable and vertically movable in said opening;

d. a keyed inner housing slidable in nonrotating relation within said outer housing and having a top bearing plate with a central cylindrical guide bearing extending upward and seated within said nozzle head;

e. a nozzle drive tube extending through said guide bearing and secured in said lower open end of said nozzle head for water discharge from within said inner housing, said drive tube having structure abutting said top plate;

f. a nozzle drive shaft in said inner housing and coupled to said drive tube;

g. an impeller in said inner housing and in fluid communication with said threaded port; and h. transmission means in said inner housing mechanically linking said impeller to said nozzle drive shaft.

7. The combination set forth in claim 6 in which said impeller is reversible and in which direction controlling means is provided below said impeller within said inner housing for selecting the direction of rotation of said impeller.

8. The combination set forth in claim 6 wherein confronting thrust surfaces within said inner housing have at least one convex member.

9. The combination set forth in claim 6 wherein said transmission means includes a speed-reduction gear train enclosed within a chamber sealed from water flow.

10. The combination set forth in claim 7 wherein said direction controlling means includes a plurality of rotating members which are located below said inner housing to control direction of rotation of said impeller and are held in contact under the compressive force of a spring to prevent unwanted relative rotation between said rotating members, and to prevent debris from passing confronting convex thrust surfaces of rotating members in said direction controlling means.

11. The combination set forth in claim 6 wherein a main water seal member is secured to said cover and wherein sealing contact with said member by said top bearing plate is effected at the outer perimeter of said housing cover thereby to minimize the stress induced in said cover.

12. The combination set forth in claim 7 wherein said direction controlling means includes:

a. a downward extending shaft seated in a lower wall of said inner housing;

b. a reversing plate rotatably mounted on said shaft below said lower wall, and having a first downward extending pin;

c. a reversing arm rotatably mounted on said shaft below said reversing plate and having a second downward extending pin and an oval slot for receiving said first pin;

d. an overcenter spring having one leg secured to said impeller cover plate and a second leg secured to the upper surface of said reversing arm;

e. a trip gear mechanically linked to said transmission means and rotatably mounted below said reversing arm, said trip gear having a transverse arm in registration with said second pin, and a first arcuate section of clutch teeth extending downward; and f. a trip plate rotatably mounted on said shaft below said trip gear and having a second arcuate section of clutch teeth to intermesh with said first arcuate section.

13. The combination set forth in claim 12 wherein said lower wall includes two downward extending limit stops defining the arc of rotation of said reversing plate, and two openings in fluid communication with said impeller so located that said reversing plate covers one of said openings while in contact with one of said limit stops and a second of said openings while in contact with a second of said limit stops.

14. The combination set forth in claim 13 wherein a first plurality of radial lines are inscribed on a lower surface of said trip gear, with each member of said plurality and a first and second radial edge of said transversely extending arm each located over a gear tooth of said first arcuate section and spaced equally apart, and a third radial edge of said trip plate is in registration with one of said plurality of radial lines or said first or second radial edge to define the width of an arc sector over which water is to be discharged.

15. The combination set forth in claim 14 wherein a second plurality of radial lines are inscribed on a lower surface of said impeller cover plate and spaced from an overcenter actuating position of said overcenter spring, and said third radial edge is in registration with one of said second plurality to indicate the center of said arc sector.

16. The combination set forth in claim 15 wherein a nozzle range tube in said nozzle head is aligned with a spacer boss of said inner housing, and a radial marker of an outer surface of said cover is aligned with said range tube to indicate the center of said arc sector to an observer.

17. The combination set forth in claim 6 in which a manually adjustable by-pass throttle means is interposed between said port and said impeller to divert a portion of water flow to said nozzle from said impeller.

18. In a pop-up, rotary sprinkler system having an outer housing, a nozzle head vertically and rotatably movable in an outer housing cover, and an inner housing attached to the nozzle head and slidably received within said outer housing and having an adjustable direction controlling mechanism and an enclosed transmission driven by a water-wheel impeller, the combination which comprises:

a. an outer housing cover shaped as a truncated right circular cone and having a centrally located opening;

b. a sand shield seated within said opening which is in continual slidable contact with said nozzle head;

c. means for effecting a seal between the top of said inner housing and said cover when said nozzle is elevated; and d. convex thrust rings integrally formed on said inner housing, and maintained in contact with confronting surfaces of rotating members of said transmission and with confronting surfaces of said impeller to seal said transmission from water flow.

19. The combination set forth in claim 18 wherein said transmission includes a train of speed-reduction gears enclosed in a water sealed chamber in said inner housing.

20. The combination set forth in claim 18 wherein confronting thrust surfaces of rotating members of said controlling mechanism are convex rings and said rotating members are rotatably mounted on a shaft extending from said inner housing and held in continual sealing contact by a compression spring on said shaft.

21. The combination set forth in claim 20 wherein said controlling means includes in downward sequence rotatably mounted on said shaft:

a. a reversing plate having a first downward extending pin;

b. a reversing arm in registration with said first pin and having a second downward extending pin;

c. a trip gear mechanically linked to said transmission and having both a first ring of downward extending clutch teeth and a transverse arm in registration with said second pin; and d. a trip plate having a second ring of upward extending clutch teeth in meshing relationship with said first ring.

22. The combination set forth in claim 18 wherein the sealing contact between the top of said inner housing and said cover occurs at the outer perimeter of said cover thereby minimizing the stress induced in said cover.

23. A pop-up, rotary sprinkler system comprising:

a. a cylindrical outer housing having an open upper end and a threaded port at a lower end for receiving a water supply conduit and having longitudinal guide keys;

b. a housing cover having a centrally located opening, with said cover being secured to the mouth of said outer housing;

c. a cylindrical nozzle head connected at a lower open end to a flange having an inner annular recess, said nozzle head being rotatable and vertically movable through said opening;

d. a nozzle sand shield fitted into shoulders and recesses in said cover in said opening as to be in continual sliding contact with said nozzle head;

e. an inner housing slidable in said outer housing in nonrotating relation maintained by said longitudinal guide keys seated in a keyway in said inner housing, said inner housing further having a top plate with a centrally located cylindrical guide extending upward and seated within said annular recess;

f. a cylindrical, hollow nozzle drive tube extending through said guide and secured within said open end of said nozzle head for flow water to be discharged, said drive tube having at the lower end thereof an outward extending rim with upper surfaces abutting thrust surfaces of said top plate;

g. a nozzle drive shaft rotatably seated within said inner housing and keyed to the lower end of said drive tube; and h. transmission means sealed within said inner housing and mechanically linking said impeller to said nozzle drive shaft.

24. The combination set forth in claim 23 in which there is provided:

a. a reversible water-wheel impeller rotatable within a chamber in said inner housing in response to fluid flow from said port; and b. adjustable direction controlling means for controlling the direction of rotation of said impeller comprising rotating members mechanically linked to said nozzle drive shaft, and located below said chamber.

25. The combination set forth in claim 23 wherein pairs of confronting thrust surfaces within said inner housing have at least one convex member.

26. The combination set forth in claim 23 wherein said transmission means includes a speed-reduction gear train enclosed within a second chamber sealed in said inner housing from water flow.

27. The combination set forth in claim 24 wherein said rotating members of said direction controlling means are held in contact under the compressive force of a spring to minimize the accumulation of sand between confronting surfaces of said rotating members.

28. The combination set forth in claim 23 wherein sealing contact of said top plate with said cover occurs at the outer perimeter of said housing cover thereby minimizing the stress induced in said housing cover.

29. The combination set forth in claim 24 wherein said direction controlling means includes:

a. a fixed shaft depending from the lower surface of said chamber;

b. a friction washer mounted on said shaft;

c. a reversing plate rotatably mounted on said shaft below said washer and having a first downward extending pin and a downward extending annular thrust ring encircling said shaft;

d. a reversing arm rotatably mounted on said shaft below said reversing plate and having a second downward extending pin and an oval slot therein for receiving said first pin;

e. an overcenter spring having one leg secured to said chamber and a second leg secured to the upper surface of said reversing arm;

f. a trip gear mechanically linked to said transmission means and rotatably mounted on said shaft below said reversing arm, said trip gear having i. a transversely extending arm in registration with said second pin, ii. an upward extending annular thrust surface encircling said shaft, and iii. a downward facing clutch tooth ring; and g. a trip plate rotatably mounted on said shaft below said trip gear and having an upward facing clutch tooth ring intermeshed with said downward facing ring.

30. The combination set forth in claim 29 wherein said chamber includes two downward extending limit stops defining the arc of rotation of said reversing plate, and two openings for fluid flow to said impeller so located that said reversing plate covers one of said openings while in contact with one of said limit stops and covers a second of said openings while in contact with a second of said limit stops.

31. The combination set forth in claim 29 wherein a first plurality of radial lines are inscribed on a lower surface of said trip gear, with each of said lines and a first and second radial edge of said transversely extending arm each located over a gear tooth of said first ring and spaced equally apart, and a third radial edge of said trip plate in registration with one of said plurality of radial lines, said first or second radial edge to define the width of an arc sector over which water is to be discharged.

32. The combination set forth in claim 29 wherein a second plurality of radial lines are inscribed on a lower surface of said chamber and spaced from an overcenter actuating position of said spring, and said third radial edge is in registration with one of said second plurality to indicate the center of said arc sector.

33. The combination set forth in claim 32 wherein a nozzle range tube in said nozzle head is aligned with a reference position on said inner housing, and a radial line is inscribed on an outer surface of said cover in alignment with said range tube to indicate the center of said arc sector.

* * * * *